United States Patent [19]

Schmidt

[11] 4,033,215

[45] July 5, 1977

[54] APPARATUS FOR CUTTING STRIPS OF MATERIAL

[76] Inventor: Volker Schmidt, Rte. 7 Todds Road., Lexington, Ky. 40502

[22] Filed: May 4, 1976

[21] Appl. No.: 683,080

[52] U.S. Cl. ..... 83/204; 83/209; 83/221; 83/371

[51] Int. Cl.[2] ..... B26D 5/20

[58] Field of Search ..... 83/204, 209, 210, 211, 83/371, 221

[56] References Cited

UNITED STATES PATENTS

| | | | |
|---|---|---|---|
| 2,016,710 | 10/1935 | Ferris | 83/204 |
| 3,548,498 | 12/1970 | Rios | 83/204 X |
| 3,664,222 | 5/1972 | Early | 83/221 X |
| 3,695,133 | 10/1972 | Finke | 83/204 |
| 3,701,300 | 10/1972 | Schmidt | 83/209 X |
| 3,735,657 | 5/1973 | Schmidt | 83/209 |

*Primary Examiner*—J. M. Meister
*Attorney, Agent, or Firm*—Frank C. Leach, Jr.

[57] ABSTRACT

Selected lengths of a strip of material are cut either continuously in an automatic mode or each selected length is cut in a manual mode by manual activation of a switch. When the thickness of the strip of the material being cut exceeds a predetermined thickness or is less than a predetermined thickness, this difference is sensed so that this portion of the strip of the material is cut as soon as it ceases to exceed the predetermined thickness or be less than the predetermined thickness. In the automatic mode, automatic cutting may be stopped after this portion of different thickness has been cut either every time or every other time, and manual activation is required to start another automatic cutting.

14 Claims, 8 Drawing Figures

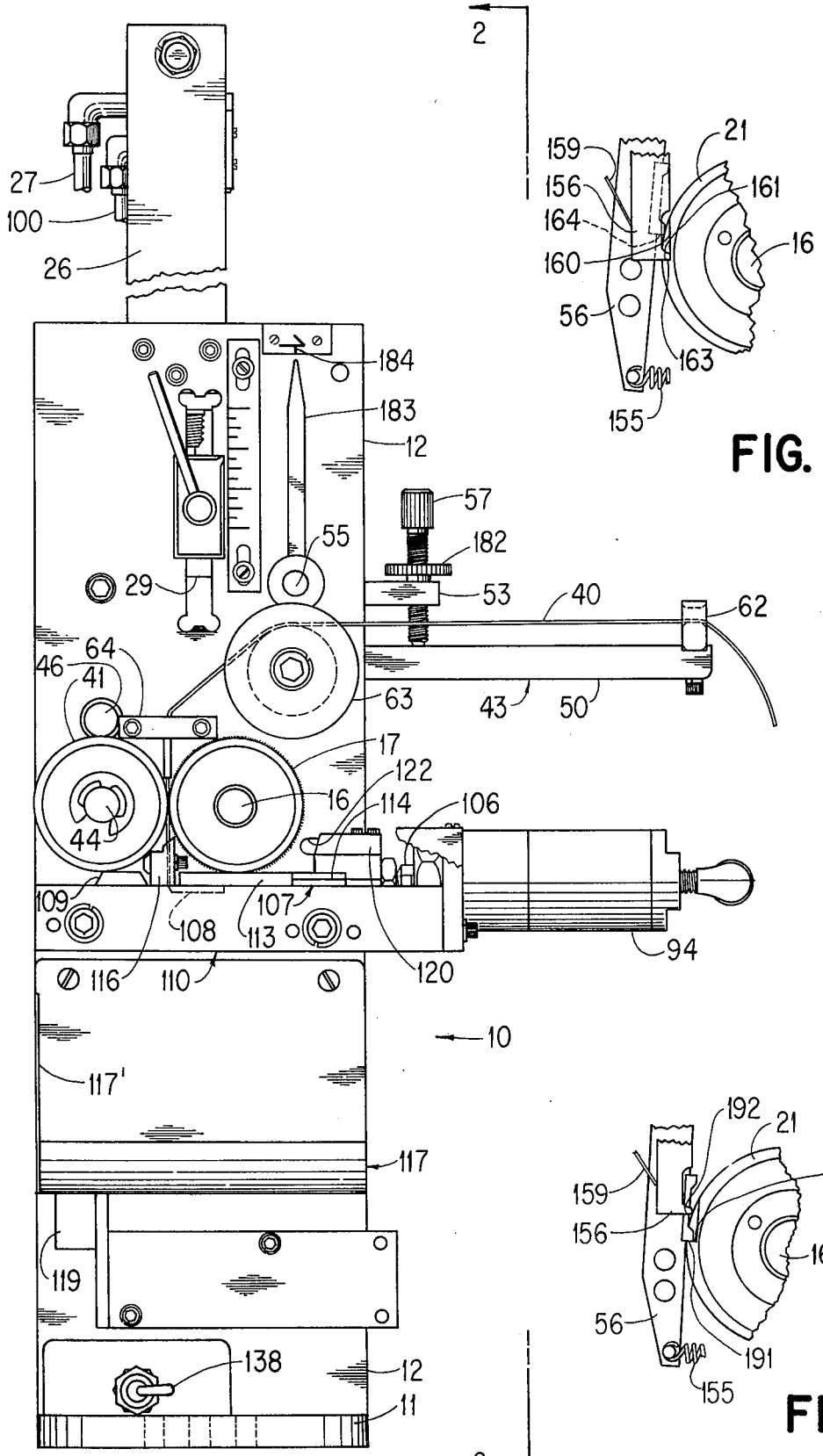
FIG. 1
FIG. 4
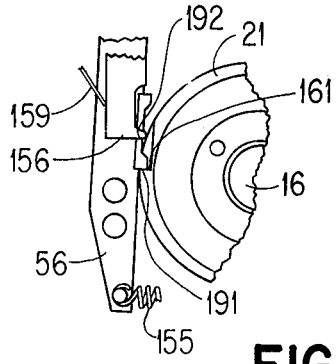
FIG. 5

APPARATUS FOR CUTTING STRIPS OF MATERIAL

In U.S. Pat. No. 3,735,657 to Volker Schmidt et al., there is shown an apparatus for cutting strips of material to any selected length. The apparatus has particular utility in cutting strips of material for use as belt loops.

In the aforesaid Schmidt el al. patent, each feeding of the strip of material for the selected length is manually activated. The aforesaid Schmidt et al. patent also discussed continuous operation of the cutting cycles through sensing when the cutting blade had completed its retraction and the rack had returned to its uppermost position.

The present invention is an improvement of the apparatus of the aforesaid Schmidt el al. patent in that it enables the cutting operation to be either manual or automatic with the automatic period of operation being run continuously or automatically stopped each time or every other time that the thickness of the fed material being cut either exceeds a predetermined thickness of the material or is less than a predetermined thickness of the material.

As discussed in the aforesaid Schmidt et al. patent, the continuous strip of material is formed by either overlaying the strips from the lays or pieces of materials and sewing them together or spacing the strips from the lays or pieces of materials from each other a slight distance and having only threads connecting the adjacent ends of two strips to each other to form the continuous strip. With the overlay, the predetermined thickness is exceeded while the use of the threads between the ends of the two adjacent strips produces a very thin connection, which is much less than the predetermined thickness, because it comprises only threads.

It should be understood that the continuous strip of material also could be formed through using a continuous liner or filler and having the strips from the lays or pieces of material sewed thereon in spaced relation to each other. Thus, the liner or filler also would be less than the predetermined thickness but greater than the very thin connection produced by the threads alone since the threads would now be passed through the continuous filler or liner.

The present invention employs selecting means to determine whether the strip of fed mateal is continuosly fed and cut until the strip either exceeds a predetermined thickness or is less than a predetermined thickness or requires manual activation for cutting each segment. The present invention also automatically stops the automatic mode of operation each time or every second time that the thickness of the material being cut exceeds a predetermined thickness or is less than a predetermined thickness through automatically inactivating the automatic means at this time whereby a predetermined number of cut segments can be collected by the operator. By having the automatic mode of operation stop only after every second time that the thickness of the strip of material being cut exceeds a predetermined thickness or is less than a predetermined thickness, all of the strips forming the belt loops for a single pair of pants, for example, can be collected by the operator each time that the automatic mode of operation ceases.

With this automatic mode, each cut piece, which has a thickness greater than a predetermined thickness or less than a predetermined thickness, can be automatically discarded. Thus, it is not necessary for the operator to have to pick up any cut segments that are not to be used as a belt loop.

Accordingly, the improved apparatus of the present invention is under the control of the operator so that automatic cutting ceases after each time or every other time that the thickness of the strip of material being cut exceeds a predetermined thickness or is less than a predetermined thickness. Therefore, the operator does not have the problem of having to stop the machine to pick up the cut segments for a particular pair of pants with which the segments are to be used as belt loops since the apparatus is automatically stopped.

The automatic mode of operation also contemplates the starting of another cycle of operation when the cut segments are picked up by the operator from a tray. Thus, another automatic cutting cylce begins as soon as the cut segments are removed from the tray so that the speed of operation is increased.

In the automatic mode in which each cut piece, which has a thickness greater than a predetermined thickness or less than a predetermined thickness, is automatically discarded, the apparatus can be operated so that it continuously cuts until it is stopped by the operator actuating a control element. However, this arrangement does not give the operator the opportunity of picking up the cut segments for a particular pair of pants because of the speed of the cutting operation.

An object of this invention is to provide an apparatus in which segments of the same length may be cut manually or automatically from a strip of material with automatic cutting stopping after a portion of a different thickness is cut in one mode and automatic cutting being continuous in another mode.

Another object of this invention is to provide an apparatus for cutting segments of the same length from a strip of material in which the operator controls whether the apparatus cuts only one segment of the strip at any selected time, cuts one-half of all of the usable segments for a particular lay or piece of material, or cuts all of the usable segments for a particular lay or piece of material. A further object of this invention is to provide an apparatus for cutting segments of the strip continuously until stopped by the operator with the non-usable segments being discarded automatically upon being cut from the strip.

Other objects of this invention will be readily perceived from the following description, claims, and drawings. The attached drawings illustrate preferred embodiments of the invention, in which:

FIG. 1 is a front elevational view of the improved cutting apparatus of the present invention with the cutting blade in its inactive position;

FIG. 4 is a fragmentary elevational view showing the cooperation of a finger and arm with the cam;

FIG. 5 is a fragmentary elevational view showing the cooperation of a finger and an arm with the cam in a modification of the apparatus of FIGS. 1 –4;

Figure 2:
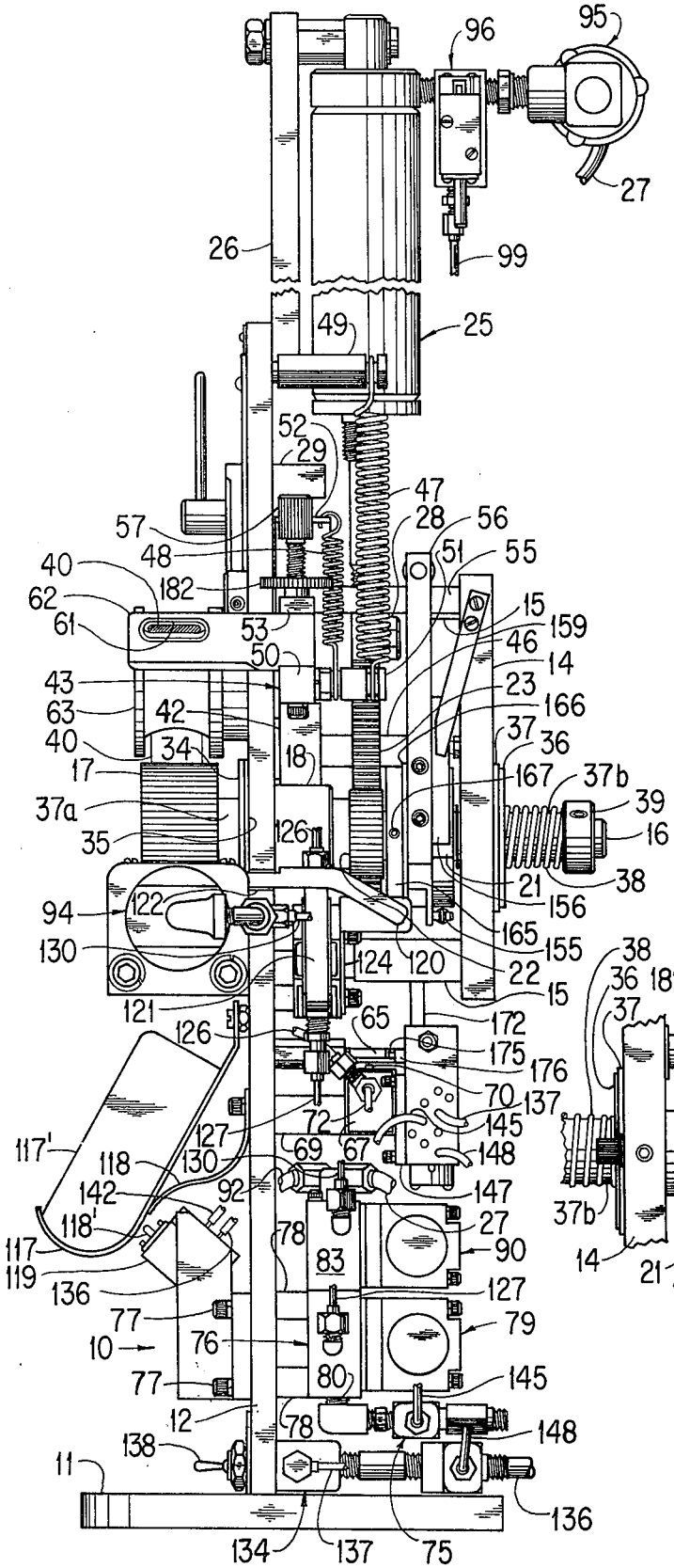
FIG. 2 is a side elevational view of the apparatus of FIG. 1 and taken along line 2 —2 of FIG. 1.
Figures 3, 7, 8:
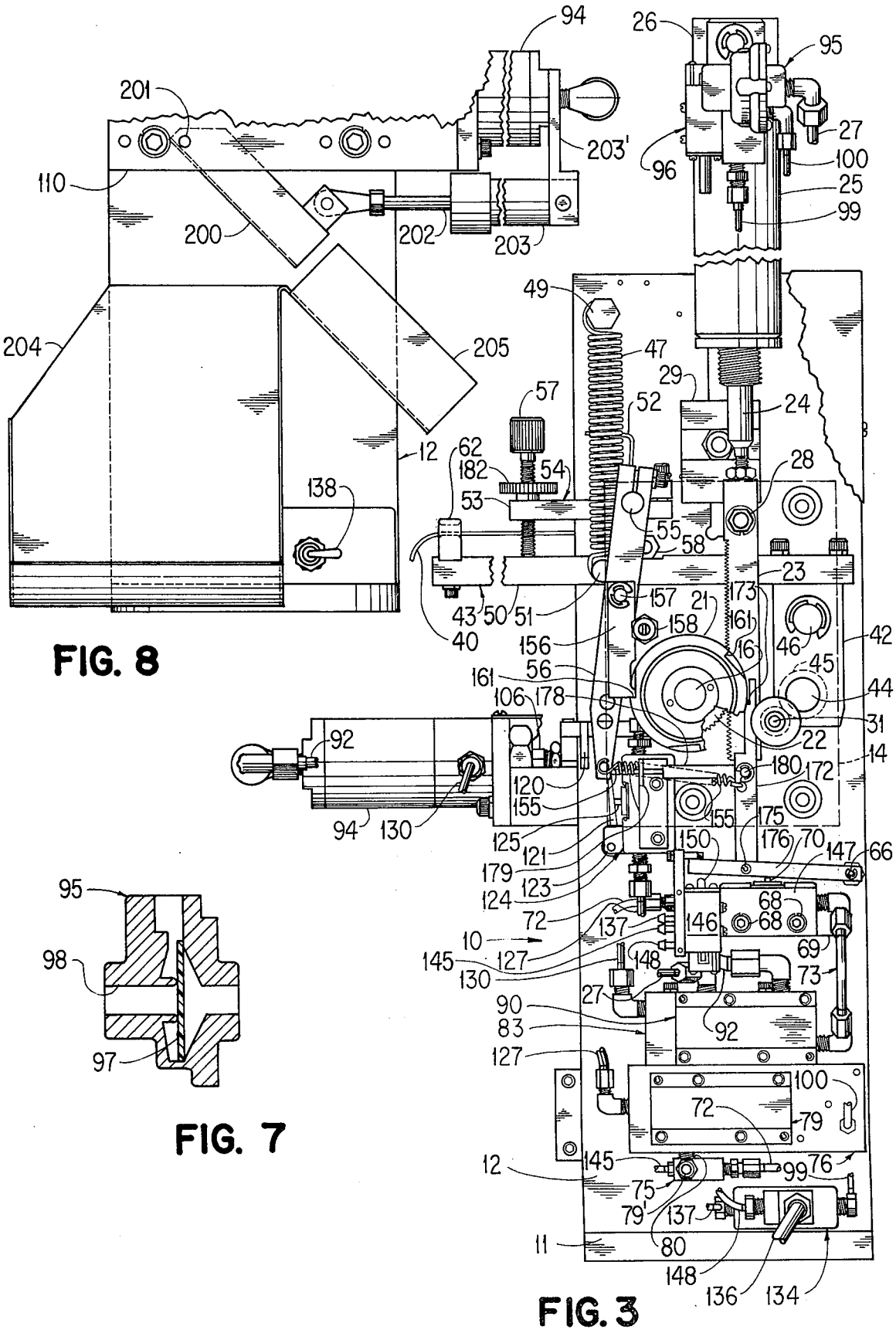
FIG. 3 is a rear elevational view of the apparatus of FIG. 1 with the cutting blade in its inactive position and the support block shown in phantom.

FIG. 7 is a fragmentary sectional view of the quick exhaust valve housing used with the cutting apparatus of the present invention; and FIG. 8 is a fragmentary elevational view of a modification of the improved cutting apparatus of the present invention. Referring to the drawings and particularly FIGS. 1 to 3, there is shown an apparatus 10 for cutting strips or portions of a selected length from a strip of material, which comprises a plurality of strips sewed to each other. The apparatus 10, which is of the type more particularly shown and described in the aforesaid Schmidt et al. patent, includes a base 11 having an upstanding support or frame 12 secured thereto. The support or frame 12 has a support block 14 (see FIG. 2 and in phantom in FIG. 3) disposed in spaced parallel relation thereto by spacers 15.

A shaft 16 is rotatably supported by the support or frame 12 and the support block 14. The shaft 16 extends beyond each side of the support or frame 12 and the support block 14. A knurled roller 17, which is preferably formed of metal, is fixed to the shaft 16 for rotation therewith. Thus, whenever the shaft 16 is rotated, the knurled roller 17 is rotated.

As more particularly shown and described in the aforesaid Schmidt et al. patent, the shaft 16 extends through a bearing housing 18 (see FIG. 2), a gear 22, and a cam 21, which are disposed between the support or frame 12 and the support block 14. The bearing housing 18 has a one direction clutch therein. The one direction clutch also rotatably supports the shaft 16 in the support or frame 12 while a roller bearing rotatably mounts the shaft 16 in the support block 14. The gear 22 also has one of the one direction clutches therein. One suitable example of the one direction clutches is sold by Torrington Manufacturing Company, Torrington, Conn. as model RCB-081214.

The one direction clutches allow the shaft 16 to be rotated in only one direction when the gear 22 is rotated. Thus, even though the gear 22 can be rotated in either direction, the shaft 16 is rotated only when the gear 22 rotates in one direction and not when the gear 22 rotates in the other direction.

The gear 22 is driven by a vertically disposed rack 23 (see FIGS. 2 and 3). The rack 23 has its upper end connected to a piston rod 24 (see FIG. 3) of an air cylinder 25, which has its upper end supported by a post 26 on the upper end of the support or frame 12. Accordingly, when pressurized air is supplied to the upper end of the air cylinder 25 through a hose 27 to act on the upper surface of the piston of the piston rod 24, the rack 23 is moved downwardly whereby the knurled roller 17 is rotated counterclockkwise (as viewed in FIG. 1) since the one direction clutches allow rotation of the knurled roller 17 in this direction. One suitable example of the air cylinder 25 is sold by Bimba Manufacturing Company, Monee, Ill. as model 173 -P.

The rack 23 is moved upwardly by a spring (not shown) disposed within the air cylinder 25 whenever there is venting of the pressurized air from the upper end of the air cylinder 25. The spring always returns the rack 23 upwardly until a stop 28 (see FIG. 2 and 3) on the rack 23 engages an L-shaped block 29, which is adjustably supported on the support or frame 12 in the manner more particularly shown and described in the aforesaid Schmidt et al. patent. When the rack 23 moves upwardly, the one direction clutches prevent the shaft 16 of the roller 17 from rotating even though the gear 22 is rotated by the rack 23.

Figure 6:
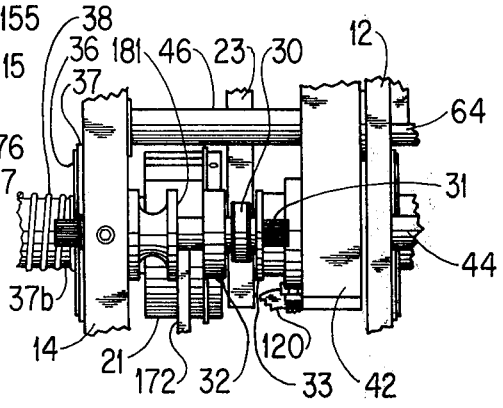
FIG. 6 is a fragmentary side elevational view of the apparatus of FIG. 1 taken from the oposite side to FIG. 2 and showing the guide arrangement for insuring vertical movements of the rack and the link.

The rack 23 has a guide roller 30 (see FIG. 6) cooperating with a surface of the rack 23 opposite to the surface having the teeth of the rack 23. The roller 30 is rotatably mounted on a stud 31, which is secured to the support block 14.

A cylindrical shaped member 32 is fixed to the stud 31 between the support block 14 and the guide roller 30 so that the end surface of the cylindrical shape member 32 is adjacent one side of the rack 23. A washer 33 is fixed to the stud 31 on the opposite side of the guide roller 30 from the cylindrical shaped member 32 so that the washer 33 has one of its end surfaces adjacent the other side of the rack 23. Accordingly, the roller 30, the member 32, and the washer 33 cooperate to form a guide for the rack 23 to insure that the rack 23 moves vertically.

When the knurled roller 17 is rotated by the downward movement of the rack 23, there is no overtravel of the knurled roller 17 when the downward movement of the rack 23 is stopped. When the roller 17 rotates, a first metallic disc 34 (see FIG. 2), which rotates with the roller 17, rubs against a first felt washer 35, which is disposed between the first disc 34 and the support or frame 12 and does not rotate with the first disc 34 because the support or frame 12 has a rough surface while the first disc 34 has a smooth surface, and a second metallic disc 36, which also rotates with the roller 17, rubs against a second felt washer 37, which is disposed between the second disc 36 and the support block 14 and does not rotate with the second disc 36 because the support block 14 has a rough surface while the second disc 36 has a smooth surface. When the roller 17 ceases to be rotated, the first disc 34 and the first felt washer 35 and the second disc 36 and the second felt washer 37 cooperate to produce the braking effect to prevent overtravel of the roller 17. This relationship of the elements preventing overtravel of the roller 17 is particularly shown and described in the aforesaid Schmidt et al. patent.

As more particularly shown and described in the aforesaid Schmidt et al. patent, the first disc 34 is rotated with the roller 17 due to two diametrically disposed pins (not shown) on a reduced portion 37*a* (see FIG. 2) of the knurled roller 17 being disposed in diametrically disposed cooperationg openings in the first disc 34. The second disc 36 rotates with the shaft 16 and the knurled roller 17 since the second disc 36 is formed integral with a cylindrical portion 37*b*, which is fixed to the shaft 16 for rotation therewith. A set screw (not shown) is fixed to the shaft 16 and extends into a longitudinal slot (not shown) in the cylindrical portion 37*b*, which is fixed to the shaft 16.

As more particularly shown and described in the aforesaid Schmidt et al. patent, the second disc 36 is urged against the second felt washer 37 by a spring 38, which surrounds the cylindrical portion 37*b*. A collar 39 is fixed to the end of the shaft 16 for rotation therewith. Accordingly, because of the longitudinal slot, the second disc 36 can move longitudinally along the axis of the shaft 16 because of the spring 38 until the second felt washer 37 is urged against the support block 14.

When the knurled roller 17 is rotated, a strip 40 of material, which is supported on a roller (not shown) separate from the apparatus of the present invention, is fed or advanced between the roller 17 and a roller 41, which is preferably formed of plastic such as nylon, for example. The roller 41 is mounted on an arm 42 (see FIGS. 2 and 3) of a lever 43 (see FIGS. 1 to 3). The roller 41 is rotatably supported on the arm 42 through being rotatably mounted on a stud 44 (see FIGS. 1 and 3), which is fixed to the arm 42 and extends from the arm 42 through an enlarged circlar opening 45 (see FIG. 3) in the support or frame 12.

The arm 42 is pivotally supported between the support or frame 12 and the support block 14 by a pin 46 (see FIGS. 2 and 3) to pivotally mount the lever 43. The lever 43 is continuously urged about the axis of the pin 46 to a position in which the roller 41 is adjacent the knurled roller 17 for cooperation therewith to permit the strip 40 of material to be fed therebetween when the knurled roller 17 is rotated. However, there is a very minute space between the rollers 17 and 41 to prevent any engagement therebetween if there is no material between the rollers 17 and 41. This prevents any damage to the roller 41 by the knurled roller 17.

The lever 43 is continuously biased by springs 47 and 48 (see FIG. 2) to the position in which the rollers 17 and 41 can cooperate so that the roller 17 can feed the strip 40 therebetween. The upper end of the spring 47 is secured to the support or frame 12 by a screw 49 and its lower end is secured to an arm 50, which is fixed to the arm 42, of the lever 43 by a screw 51.

The lower end of the spring 48 (see FIG. 2) is secured to the arm 50 of the lever 43 by the screw 51 while the upper end of the spring 48 is secured to a bracket 52, which is secured to an arm 53 (see FIG. 3) of a lever 54. The lever 54 is part of a mechanism for sensing when a thickened portion, which results from the sewing together of two strips from two pieces or lays of material and overlapping them, of the strip 40 of material enters and leaves between the rollers 17 and 41.

The lever 54 includes a pivot pin 55, which is rotatably mounted in the support or frame 12 and the support block 14 to permit the lever 54 to pivot. In addition to the arm 53 being fixed to the pivot pin 55, an arm 56 also is fixed to the pivot pin 55 and forms part of the lever 54.

The arm 53 of the lever 54 has an adjusting screw 57 supported thereon with its bottom edge engaging the top surface of the arm 50 of the lever 43. Since the lever 43 is connected to the roller 41, movement of the roller 41 away from the knurled roller 17 due to the thickened portion passing therebetween results in the lever 43 pivoting counterclockwise (as viewed in FIG. 3) against the force of the springs 47 and 48. When the thickened portion ceases to pass between the rollers 17 and 41, the arm 50 of the lever 43 returns to the position of FIGS. 1 and 3 due to the force of the springs 47 and 48.

While the adjusting screw 57 normally holds the lever 43 in a position in which the lever 43 cannot be moved by the springs 47 and 48 to a position in which the roller 41 would engage the roller 17, a stop 58 (see FIG. 3), which is supported on the support or frame 12, is disposed to cooperate with the upper surface of the arm 50 of the lever 43 to limit the movement of the lever 43 by the springs 47 and 48 if the adjusting screw 57 is ever moved to a position in which it would no longer prevent engagement of the roller 41 with the roller 17. Thus, the stop 58 insures the lever 43 cannot be moved by the springs 47 and 48 to a position in which the roller 41 would engage the roller 17 irrespective of the position of the adjusting screw 57.

The strip 40 of material is fed through an opening 61 (see FIG. 2) in a lead-in guide 62 on the end of the arm 50 of the lever 43 and then over a guide roll 63 (see FIG. 1), which is secured to the support or frame 12 with respect to the opening 61 in the lead-in guide 62 so that the portion of the strip 40 of material between the guide 62 and the guide roll 63 is substantially horizontal when the arm 50 is in the position of FIGS. 1 and 3.

A feed-in guide 64 is supported on the support or frame 12 and has an opening therein vertically aligned with the space between the rollers 17 and 41. Thus, the strip 40 of material is vertical when it passes between the rollers 17 and 41.

As previously mentioned, the downward movement of the rack 23 causes rotation of the knurled roller 17 whereby the strip 40 is fed by the roller 17 cooperating with the roller 41 at this time. The downward movment of the rack 23, which is connected to the piston rod 24 of the air cylinder 25, is stopped by the piston of the piston rod 24 engaging a spacer, which is supported by the air cylinder 25 within the spring in the air cylinder 25, to prevent any further movement.

The downward movement of the rack 23 ceases after the end of the rack 23 engages a finger 65 (see FIG. 2), which is mounted on a pivot or hinge pin 66 (see FIG. 3) for pivotal movement about the axis of the pin 66. The pivot pin 66 is fixed to the support or frame 12.

The downward movement of the rack 23 ceases prior to the finger 65 fully engaging a valve housing 67 (see FIG. 2), which is supported on the support or frame 12 by two screws 68 (see FIG. 3) extending through a spacer 69 (see FIG. 2) so that the valve housing 67 is disposed in spaced relation to the support or frame 12, but not before a resiliently biased button 70 of the valve housing 67 is engaged by the finger 65. When the button 70 is moved inwardly by the finger 65 against the force of a spring in the valve housing 67, a valve (not shown), which is connected to the button 70, in the valve housing 67 is moved to a position in which an inlet having a hose 72 (see FIG. 3) connected thereto and an outlet having a hose 73 connected thereto communicate with each other so that the hoses 72 and 73 communicate with each other. When the button 70 is not engaged by the finger 65 so that the button 70 is urged outwardly of the valve housing 67 by the spring in the valve housing 67, the valve in the valve housing 67 is moved so that an inlet in the bottom of the valve housing 67 communicates with the outlet to which the hose 73 is connected whereby the hose 73 is vented to the atmosphere through the inlet in the bottom of the valve housing 67. One suitable example of the valve construction forming the valve housing 67 is a three way miniature control valve sold by The Aro Corporation, Bryan, Ohio as model 209 C.

The hose 72 is connected to a source of fluid pressure such as an air compressor, for example, through a fitting 75 which is carried by a fluid distribution block 76. The fluid distribution block 76 is supported on the support or frame 12 by two screws 77 (see FIG. 2) extending through two spacers 78 so that the fluid distribution block 76 is disposed in spaced relation to the support or frame 12.

The fluid distribution block 76 has a valve housing 79 mounted thereon and in communication with passages within the fluid distribution block 76. One suitable example of the valve construction forming the valve housing 79 is a double pilot operated four way valve sold by The Aro Corporation, Bryan, Ohio as model 59180.

Pressurized air is supplied from the source of fluid pressure to the fitting 75 by a hose to a port 79' (see FIG. 3) in the fitting 75. The fitting 75 supplies the pressurized air from the port 79' by a connection 80 (see FIG. 2 to an inlet port in the fluid distribution block 76.

The valve housing 79 has a valve spool therein movable in one direction when pressurized air is applied against one end and movable in the opposite direction when pressurized air is applied against the other end. The valve spool remains in the position to which it is moved until pressurized air is applied to the opposite end.

The fluid distribution block 76 has a fluid distribution block 83 mounted thereon so that the fluid distribution block 83 is disposed in spaced relation to the support or frame 12. The fluid distrubution block 76 has a first passage and a second passage communicating with a first passage and a second passage, respectively, in the distribution block 83. An O-ring (not shown) prevents any leakage between the first passages in the distribution blocks 76 and 83 and an O-ring (not shown) prevents any leakage between the second passages in the distribution blocks 76 and 83.

The hose 73 (see FIG 3) is connected from the valve housing 67 through a third passage in the fluid distribution block 83 to an inlet port of a valve housing 90, which is supported on the fluid distribution block 83. The construction of the valve housing 90 is the same as the construction of the valve housing 79.

Accordingly, the valve housing 90 has a valve spool therein movable in one direction when pressurized air is applied against one end and movable in the opposite direction when pressurized air is applied against the other end. The valve spool remains in the position to which it is moved until pressurized air is applied to the opposite end.

Therefore, when the hose 73 supplies pressurized air through the inlet port of the valve housing 90, this pressurized air acts on the valve spool in the valve housing 90 to shift its position. This pressurized air is supplied though the hose 73 from the source of fluid pressure when feeding of the strip 40 of the material has stopped because the rack 23 has stopped moving after causing the finger 65 to move the button 70 to a position in which the hose 72 communicates with the hose 73 through the valve housing 67.

The shifting of the valve spool in the valve housing 90 results in the pressurized air, which is being supplied to the valve housing 90 from the valve housing 79 through the second passage in the fluid distribution block 76 and the second passage in the fludi distribution block 83, being supplied to a hose 92 (see FIG. 3) and removed from supply to the hose 27, which is now connected to the atmosphere through an exhaust port in the valve housing 90 because of the position of the valve spool in the valve housing 90.

The hose 92 leads to one end of a horizontally disposed air cylinder 94 which is supported on the support or frame 12. One suitable example of the air cylinder 94 is sold by Bimba Manufacturing Company, Monee, Ill. as model 170.5-D.

The hose 27 is connected to the upper end of the air cylinder 25 through a quick exhaust valve housing 95 and a sensing valve housing 96. The quick exhaust valve housing 95 has a diaphragm 97 (see FIG. 7) therein to enable the pressurized air to flow through the housing 95 and 96 to act on the cylinder 25 to move it downwardly.

Accordingly, when pressurized air is removed from the hose 27 by shifting of the valve spool in the valve housing 90 because of the rack 23 engaging the finger 65 to move the button 70 to a position in which the hoses 72 and 73 communicate, the air flows from the top of the cylinder 25 through the sensor housing 96 into the quick exhaust valve housing 95. The diaphragm 97 is moved by the air to a position which the air can exhaust through a port 98 (see FIG. 7) in the housing 95.

The sensing valve housing 96 has hoses 99 and 100 (see FIG. 3) connected thereto with a valve in the sensing valve housing 96 preventing communication between the hoses 99 and 100 whenever there is any flow of air to or from the cylinder 25. Thus, the valve in the sensing valve housing 96 can open only when the rack 23 is at its uppermost position since this is the only time that there is not pressurized air flowing into or out of the top of the cylinder 25.

One suitable example of the quick exhaust valve housing 95 is sold by Auto-Ponents, Inc., Bellwood, Ill. as model EX-25. One suitable example of the sensing valve housing 96 is sold by Dynamco Air Controls Division, Dallas, Tex. as model X138 1E.

The air cylinder 94 has its piston rod 106 (see FIG. 1) connected through connecting means 107 to a knife or cutting blade 108 as shown in FIG. 1. Thus, when pressurized air is supplied through the hose 92 to the air cylinder 94, the knife 108 is moved relative to a stationary knife or cutting blade 109, which is supported by the support or frame 12 through interconnected support blocks (one shown at 110 in FIG. 1) held in spaced relation by blocks as more particularly shown and described in the aforesaid Schmidt et al. patent.

Each of the support blocks (one shown at 110 in FIG. 1) has a guide 113 (one shown in FIG. 1 on the support block 110) supported thereon to guide the connecting means 107 for horizontal movement so that the cutting blade 108 is maintained in the desired relationship with respect to the stationary knife or cutting blade 109. Each of the guides 113 has a flange overlying an adjacent horizontal surface (one shown at 114 in FIG. 1) of the connecting means 107.

The knife or cutting blade 108 cuts the strip 40 of material after it has passed through an opening (not shown) in a guide 116 (see FIG. 1), which is supported by the blocks (one shown at 110 in FIG. 1); the strip 40 of material passes through the opening in the guide 116 after being fed by the rollers 17 and 41. Thus, as the strip 40 of material passes through the opening in the guide 116, it is cut by the knife or cutting blade 108 moving beneath the bottom of the guide 116 and into cooperating engagement with the stationary knife or cutting blade 109 as more particularly shown and described in the aforesaid Schmidt et al. patent.

After the selected length of the strip 40 of material has been cut by the movement of cutting blade 108, the cut segment falls into a tray 117, which is loosely secured to the support or frame 12. The bottom of the tray 117 is curved, and one side of the tray 117 has a wall 117' secured thereto. Thus, the cut segments are easily collected in the tray 117.

A spring 118 (see FIG. 2), which is secured to the support or frame 12, continuously urges the tray 117 to a position in which a resiliently biased button 118' of a valve housing 119, which is mounted on the support or frame 12, extends outwardly from the valve housing 119. One suitable example of the valve construction forming the valve housing 119 is sold by the Dynamco Air Controls Division, Dallas, Tex. as model ML3KE.

When the knife or cutting blade 108 is moved to the position in which cutting of the strip 40 of material occurs, a finger 120 on the cutting means 107 engages a resiliently biased arm 121 (see FIGS. 2 and 3) by extending through a horizontal slot 122 in the support or frame 12. The arm 121, which is pivotally mounted on a bracket 123 carried by a valve housing 124 fixed to the support or frame 12 but spaced therefrom, is moved into engagement with a resiliently biased button 125 (see FIG. 3) of the valve housing 124. One suitable example of the valve construction forming the valve housing 124 is a three way miniature control valve sold by The Aro Corporation, Bryan, Ohio as model 200.

When the button 125 is activated by the arm 121, pressurized air now flows from the hose 72 through a hose 126 (see FIG. 2) to the upper end of the valve housing 124, through the valve housing 124 due to the change in position of the valve therein by the activation of the button 125, and through a hose 127 to a third passage in the fluid distribution block 76 whereby pressurized air flows through an inlet port, which has the third passage in the fluid distribution block 76 connected thereto, in the valve housing 79 to change the position of the valve spool in the valve housing 79.

The change in position of the valve spool in the valve housing 79 results in pressurized air being removed from supply to the second passages in the fluid distribution blocks 76 and 83 whereby pressurized air is no longer supplied through the hose 92 to the air cylinder 94. Instead, pressurized air is supplied through the first passages in the fluid distribution blocks 76 and 83 to a hose 130 (see FIG. 3), which leads to the opposite side of the air cylinder 94 from that to which the hose 92 is connected. Thus, pressurized air is supplied to the cylinder 94 to cause it to retract the cutting blade 108.

When the valve spool in the valve housing 79 shifts positions because of the pressurized air supplied through the hose 127, the second passages in the fluid distribution blocks 76 and 83 are vented to the atmosphere through an outlet in the valve housing 79. As a result, the cutting blade 108 may be easily returned to its inactive position due to the retraction of the piston rod 106 into the cylinder 94 since the hose 92 is always vented to the atmosphere during this retraction.

It should be understood that the valve spool in the valve housing 79 was initially positioned to cause pressurized air to be supplied through a fourth passage in the fluid distribution block 76 to an inlet port in the valve housing 79. A pulse pressurized air is supplied to the fourth passage in the fluid distribution block 76 from the hose 100 (see FIG. 3).

The pulse of pressurized air is supplied to the hose 100 from the hose 99 only when there is no air flowing through the sensing valve housing 96. This is when the rack 23 has been retracted to its maximum upward position.

The flow of pressurized air to the hose 99 is supplied from the source of fluid pressure through a valve housing 134 (see FIG. 3), which has a valve movable between two different positions. In one of these positions of the valve, the hose 99 communicates with a hose 136. In the other position of the valve within the valve housing 134, the hose 99 communicates with a hose 137. The position of the valve in the valve housing 134, which is mounted on the support or frame 12, is determined by a manual lever 138 (see FIGS. 1 and 2). One suitable example of the valve construction forming the valve housing 134 is a three way miniature control valve sold by The Aro Corporation, Bryan, Ohio as model 223 B.

When the lever 138 is positioned so that the valve in the valve housing 134 is disposed to enable the hose 99 to communicate with the hose 136 while blocking communication of the hose 137 with the hose 99, pressurized air is supplied from the source of fluid pressure through the valve housing 119 to the hose 136. The valve housing 119 has a fitting connected thereto and to which a hose 142 is connected to the source of fluid pressure.

With the valve in the valve housing 134 positioned so that there is communication between the hoses 99 and 136, the resiliently biased button 118′ in the valve housing 119 must be manually depressed by the operator removing the cut segments from the tray 117 to move a valve in the valve housing 119 to a position in which the hoses 142 and 136 communicate so that pressurized air can be supplied to the hose 99. It is necessary that the button 118′ be moved to its open position when upward motion of the rack 23 has ceased. Otherwise, there will be no downward motion of the rack 23 because the sensing valve housing 96 is sensing air flow therethrough either to or from the air cylinder 25 so that the hoses 99 and 100 cannot communicate to supply the pressurized air to the valve housing 79 to shift the position of the valve spool therein. Therefore, if the operator does not wait until the rack 23 has ceased upward motion before removing the cut segments from the tray 118, the tray 118 must be depressed after upward motion of the rack 23 has ceased or the operator must continue to depress the button 118′ by pushing on the tray 118 until after upward motion of the rack 23 has ceased.

Thus, with the hoses 99 and 136 in communication because of the position of the valve in the valve housing 134, it is necessary for the button 118′ to be depressed at the end of each cutting cycle. Therefore, this is a manual mode of operation. If desired, the valve housing 119 could be disposed to have the button 118′ depressed by foot activation of the operator rather than by removing cut segments from the tray 117.

If it is desired for there to be automatic cutting of the strip 40 of material, then the lever 138 of the valve housing 134 is moved to the position in which the valve in the valve housing 134 blocks communication between the hoses 99 and 136 and provides communication between the hoses 99 and 137.

With the hoses 99 and 137 in communication, pressurized air is supplied to the hose 99 from the source of fluid pressure through the port 79′ (see FIG. 3) in the fitting 75, the fitting 75, and a hose 145 to a valve housing 146, which is supported by a bracket 147 (see FIG. 2) on the valve housing 67. The hoses 137 and 145 communicate with each other when pressurized air is supplied to the valve housing 146 from a hose 148, which is connected to the hose 136. Thus, the initial activation of a valve spool in the valve housing 146 to provide communication between the hoses 137 and 145 requires depression of the button 118′ of the valve housing 119 to supply a pulse of pressurized air from the hose 136 through the hose 148 to the valve housing 146.

When the pressurized air is supplied through the hose 148 to the valve housing 146 to shift the valve spool in the valve housing 146, the hoses 137 and 145 communicate with each other and remain in this position because the valve spool in the valve housing 146 is held by a detent. One suitable example of the valve construction forming the valve housing 146 is sold as model X137 GE by Dynamco Air Controls Division, Dallas, Tex.

The valve housing 146 continues to provide communication between the hoses 145 and 137 until a resiliently biased button 150 is moved into the valve housing 146. When this occurs, the valve spool in the valve housing 146 is shifted to a detent position in which the hoses 137 and 145 no longer communicate with each other. This occurs after each of the thickened portions of the strip 40 of material has been fed past the cutting position.

Furthermore, since the hose 148 always communicates with the hose 136, the valve housing 146 again provides communication between the hoses 137 and 145 upon depression of the button 118' in the valve housing 119 after every time that the thickened portion of the strip 40 of material has been cut. However, it should be understood that it is the valve in the valve housing 134 that controls whether there is supply of pressurized air through the hose 137 to the hose 99 since the hoses 137 and 145 are always connected to the source of fluid pressure any time that there is a depression of the button 118' in the valve housing 119.

Since the button 150 is depressed only after the thickened portion of the strip 40 of material has been fed past the cutting position, it is necessary to sense when this occurs. As previously mentioned, the lever 54 forms part of a mechanism for sensing when a thickened portion of the strip 40 of material enters and leaves between the rollers 17 and 41.

When the arm 50 of the lever 43 pivots counterclockwise (as viewed in FIG. 3) due to the thickened portion of the strip 40 of material passing between the rollers 17 and 41, the arm 53 of the lever 54 also pivots counterclockwise because the adjusting screw 57 is maintained in contact with the top surface of the arm 50 of the lever 43. This is due to an extension spring 155, which is connected to the lower end of the arm 56, urging the lever 54 counterclockwise (as viewed in FIG. 3).

The arm 56 of the lever 53 has a finger 156, which terminates short of the end of the arm 56 of the lever 53, pivotally mounted thereon by a pin 157. The finger 156 is urged against a stop 158 on the support block 14 by a spring 159 (see FIG. 2), which is carried by the support block 14.

The finger 156 and the arm 56 of the lever 53 are disposed for cooperation with a cam profile 160 (see FIG. 4), which has a plurality of equally angularly spaced lobes 161 (preferably three), of the cam 21. The finger 156 has a shoulder 163 thereon adapted to engage each of the lobes 161 on the cooperating cam profile 160 of the cam 21 at different times. The arm 56 of the lever 53 has a shoulder 164 (see FIG. 4) thereon for also engaging each of the lobes 161 on the cooperating cam profile 160 of the cam 21 at different times.

The shoulder 163 of the finger 156 is positioned at a lower point from the axis of the pivot pin 157 than the shoulder 164. Accordingly, when the cam 21 rotates clockwise (as viewed in FIG. 3), one of the lobes 161 is initially engaged by the shoulder 163 of the finger 156. The same one at the lobes 161 is engaged by the shoulder 164 of the arm 56 only when the shoulder 163 is removed from engagement with the lobe 161 and the cam 21 rotates clockwise a slight amount.

As more particularly shown and described in the aforesaid Schmidt et al patent, the cam 21 is rotatably mounted on the shaft 16 between a first metallic disc 165 (see FIG. 2) and a second metallic disc. A first felt washer 166 is disposed between the first disc 165 and the cam 21, and a second felt washer is disposed between the cam 21 and the second metallic disc. The first metallic disc 165, which is adjacent one end of the gear housing 19, is fixed to the shaft 16 for rotation therewith by a set screw 167 so that the first metallic disc 165 rotates whenever the shaft 16 rotates.

The second metallic disc, which is disposed within a hollow portion of the cam 21 as shown in the aforesaid Schmidt et al patent, rotates with the shaft 16 because of two diametrically disposed drive pins being disposed in two diametrically disposed holes in the second disc and in corresponding longitudinal slots in a collar, which is fixed to the shaft 16 by a set screw. A spring is disposed between the collar and the second disc in surrounding relation to the collar to urge the second disc toward the cam 21.

Accordingly, the cam 21 always seeks to rotate clockwise (as viewed in FIG. 3) with the shaft 16. However, the shoulder 163 of the finger 156 normally prevents rotation of the cam 21 with the shaft 16 because of the shoulder 163 engaging one of the lobes 161 on the cam profile 160 of the cam 21.

However, when the arm 50 of the lever 43 is pivoted counterclockwise due to the thickened portion of the strip 40 of material entering between the rollers 17 and 41, the arm 53 follows the movement of the arm 50 of the lever 43. This causes the arm 56 of the lever 54 to be moved into engagement with the cooperating cam profile 160 of the cam 21.

This counterclockwise pivoting of the lever 54 about the axis of the pivot pin 55 so that the arm 56 moves toward the cam 21 shifts the position of the pivot pin 157. Because the stop 158 prevents movement of the finger 156 toward the cam 21 when the lever 54 pivots counterclockwise while not extending sufficiently from the support block 14 to prevent movement of the arm 56, the finger 156 pivots clockwise about the axis of the pivot pin 157 against the force of the spring 159 whereby the shoulder 163 of the finger 156 is removed from engagement with the cooperating cam profile 160 of the cam 21. When this occurs, the driving relation between the shaft 16 and the cam 21 causes clockwise rotation of the cam 21 with the shaft 16 since none of the lobes 161 is any longer engaging the shoulder 163 of the finger 156. This is a small amount of rotation because of the relatively short distance between the shoulders 163 and 164.

When the shoulder 164 of the arm 56 engages the same one of the lobes 161 on the cooperating cam profile 160 of the cam 21 with which the shoulder 163 had been engaged, clockwise rotation of the cam 21 by the shaft 16 is again stopped. However, this small amount of clockwise rotation of the cam 21 results in the finger 156 not being able to return into cooperation with the lobe 161 on the cam profile 160 of the cam 21 with which it cooperates when the arm 50 of the lever 43 is returned to the position of FIG. 3; this occurs when the thickened portion of the strip 40 of material ceases to be disposed between the rollers 17 and 41.

When the arm 50 of the lever 43 is returned to the position of FIG. 3, the lever 54 is pivoted clockwise about the axis of the pivot pin 55 to move the shoulder 164 on the arm 56 out of engagement with the lobe 161 on the cooperating cam profile 160 of the cam 21. Since the shoulder 163 on the finger 156 cannot return into engagement with the same lobe 161 on the cooperating cam profile 160 of the cam 21 with which it was engaged because of the slight clockwise rotation of the cam 21 when the shoulder 163 on the finger 156 was removed from engagement with the lobe 161 on the cooperating cam profile 160 of the cam 21, the cam 21 is no longer held against rotation by either the shoulder 163 on the finger 156 or the shoulder 164 on the arm 56 whereby the cam 21 rotates clockwise with the shaft 16.

When the shaft 16 has rotated the cam 21 a sufficient distance to advance the thickened portion of the strip 40 of material just beyond the position in which the movable cutting blade 108 cooperates with the stationary cutting blade 109 to cut the strip 40 of material so that all of the thickened portion is removed, a link 172, which cooperates with the same portion of the cam profile 160 (see FIG. 2) of the cam 21 as the arm 56 due to the extension spring 155 that extends between the link 172 and the end of the arm 56 is moved downwardly because of another of the lobes 161 on the cam profile 160 engaging a shoulder 173 (see FIG. 3) on the upper end of the link 172 as the cam 21 rotates clockwise with the shaft 16.

The lower end of the link 172 is connected by a pin 175 to a finger 176, which is disposed above the push button 150 of the valve housing 146 and is pivotally or hinged mounted on the pin 66. The detent locking of the valve spool in the valve housing 146 acting on the button 150 exerts a sufficient force to prevent the finger 176 from moving the button 150 inwardly into the valve housing 146 unless the link 172 is moved downwardly by the cam 21.

When the finger 176 is pivoted downwardly by the link 172, the force exerted by the detent locked valve spool in the valve housing 146 on the button 150 is overcome so that the button 150 is moved inwardly to shift the valve spool in the valve housing 146 to its other detent locked position in which communication between the hoses 145 and 137 is stopped. Since the pin 175 extends from the finger 176 over the finger 65, the counterclockwise pivoting of the finger 176 about the hinge or pivot pin 66 by the downward movement of the link 172 results in the pin 175 causing the finger 65 to also pivot counterclockwise about the pin 66. As a result, the button 70 of the valve housing 67 also is moved inwardly to open the valve in the valve housing 67.

The opening of the valve in the valve housing 67 allows communication between the hoses 72 and 73 so that the pressurized air in the hose 73 shifts the valve spool in the valve housing 90. This shifting of the valve spool in the valve housing 90 removes the pressurized air from the hose 27 to prevent further downward movement of the rack 23 whereby feeding of the strip 40 of the material is stopped.

This stopping of the downward movement of the rack 23 can occur with the rack 23 in any position, and it does not depend upon the piston of the piston rod 24 abutting the spacer in the air cylinder 25. Furthermore, the removal of the pressurized air from the hose 27 results in the spring in the air cylinder 25 rapidly moving the rack 23 upwardly because of the venting of the upper end of the air cylinder 25 through the quick exhaust valve housing 95.

The shifting of the valve spool in the valve housing 90 because of the supply of the pressurized air through the hose 73 also enables pressurized air to be supplied to the air cylinder 94. This causes the cutting blade 108 to be advanced to cut the strip 40 of material in cooperation with the stationary cutting blade 109.

Upon completion of advancement of the cutting blade 108, the valve in the valve housing 124 is activated by the finger 120 engaging the arm 121 to cause the supply of pressurized air from the hoses 72 and 126 through the hose 127 to shift the position of the valve spool in the valve housing 79. This shifting of the valve spool in the valve housing 79 results in pressurized air being supplied through the hose 130 to the air cylinder 94 to retract the cutting blade 108.

The finger 120 also cooperates with a link 178, which has its free end supported by a guide 179 fixed to the valve housing 124. The link 178 is connected to the link 172 by a pin 180. Accordingly, when the link 178 is moved by the finger 120 at the completion of the advancement of the cutting blade 180, the link 172 is shifted so that it is moved out of engagement with the cooperating cam profile 160 of the cam 21 by moving the link 172 against the force of the spring 155.

The spring 155 is connected to the link 152 beneath the pin 180. Thus, the spring 155 is disposed at an angle to the link 178 so that the spring 155 exerts an upward force on the link 172 when the link 178 releases the link 172 from the cam 21.

When the link 172 is shifted by the link 178 due to the cutting blade 108 completing its advancement, the removal of the link 172 from engagement with one of the lobes 161 on the cooperating cam profile 160 of the cam 21 results in the link 172 being moved upwardly slightly because of the spring 155 exerting the upward force on the link 172. This positions the link 172 so that it cannot engage the same lobe 161 on the cooperating cam profile 160 of the cam 21 when the cutting blade 108 is retracted. Then, when the link 178 ceases to hold the link 172 out of contact with the cooperating cam profile 160 because the finger 120 no longer engages the link 178 whereby the spring 155 becomes effective to return the link 172 into engagement with the cooperating cam profile 160 of the cam 21, the upper end of the link 172 moves to a position in which the shoulder 173 cannot be disposed to engage the same lobe 161 on the cooperating cam profile 160 of the cam 21 because of the prior upward movement of the link 172 by the spring 155.

When the link 172 moves upwardly because of the shifting by the link 178 and the upward force of the spring 155, the button 150 of the valve housing 146 does not move outwardly because the valve spool in the valve housing 146 is detent locked in the position to which it has been moved by the downward movement of the link 172. Therefore, no further feeding of the strip 40 of material can occur until the button 118' of the valve housing 119 is manually activated by the operator withdrawing the cut segments from the tray 117 to cause the button 118' to be moved into the valve housing 119 to enable another pulse of pressurized air to be supplied through the hoses 136 and 148 to the valve housing 146 to again shift the valve spool in the valve housing 146 to the detent locked position in which the hoses 145 and 137 communicate and the button 150 extends outwardly of the valve housing 146.

However, the upward movement of the link 172 results in the button 70 of the valve housing 67 moving outwardly because it is resiliently biased. As a result, communication between the hoses 72 and 73 is blocked by the valve in the valve housing 67 with the valve in the valve housing 67 venting the hose 73 to the atmosphere through the inlet in the bottom of the valve housing 67.

When the cutting blade 108 completes its advance, pressurized air is supplied to the air cylinder 94 through the hose 130 to retract the cutting blade 108 because the button 125 of the valve housing 124 was moved inwardly at the completion of the advancement of the cutting blade 108 by the finger 120 engaging the arm 121 of the valve housing 124. This position of the valve in the valve housing 124 enabled a pulse of pressurized air to be supplied through the hoses 72, 126, and 127 and the third passage in the fluid distribution block 76 to shift the position of the valve spool in the valve housing 79. As a result, pressurized air is supplied through the first passage in the fluid distribution block 76 and the first passage in the fluid distribution block 83 to the hose 130.

Because of the removal of the pressurized air from the second passage in the fluid distribution block 83 due to the shifting of the valve spool in the valve housing 79, the second passage in the fluid distribution block 83 communicates with the atmosphere through an exhaust port in the valve housing 79. Thus, the other end of the air cylinder 94 is vented through the hose 92 at this time since the hose 92 is in communication with the second passage in the fluid distribution block 83.

With the return of the cutting blade 108 to its inactive position and the rack 23 to its uppermost position, it is only necessary for the operator to cause depression of the button 118' of the valve housing 119 to cause another automatic cycle to occur in which cutting of segments from the strip 40 of material continuously occurs until the next thickened portion is cut. This is because the pulse of pressurized air is supplied to the valve housing 146 to connect the hoses 145 and 137 whereby a pulse of pressurized air is supplied through the hoses 99 and 100 to shift the valve spool in the valve housing 79 to the position in which pressurized air is supplied to the second passages in the fluid distribution blocks 76 and 83 rather than to the first passages in the fluid distribution blocks 76 and 83.

The upper end of the link 172 is vertically guided in a groove 181 (see FIG. 6) formed in the cylindrical shaped member 32 on the stud 31. Thus, the link 172 is caused to move in a substantially vertical direction because of the disposition of the link 172 in the groove 181 and the connection of the link 172 by the pin 175 to the finger 176.

As previously mentioned, the arm 53 of the lever 54 has the adjusting screw 57 mounted thereon. The position of the adjusting screw 57 determines when the shoulder 163 of the finger 156 is withdrawn from engagement with one of the lobes 161 on the cooperating cam profile 160 of the cam 21.

Accordingly, the adjusting screw 57 must be set to insure that the removal of the shoulder 163 from engagement with each of the lobes 161 occurs at the desired time. Thus, the adjusting screw 57 has a lock nut 182 cooperating therewith to retain the adjusting screw 57 in the desired position.

To obtain the desired position of the adjusting screw 57 in accordance with the thickness of the strip 40 of material being cut, the pivot pin 55 has a pointer 183 (see FIG. 1) attached thereto for cooperation with a mark 184 on the support of frame 12. To set the adjusting screw 57, the strip 40 of material is fed between the rollers 17 and 41. If the pointer 183 is not aligned with the mark 184, the lock nut 182 is turned to release the adjusting screw 57. Then, by holding the lock nut 182 and turning the adjusting screw 57, the lever 54 pivots until the pointer 183 aligns with the mark 184. When this occurs, the lock nut 182 is again tightened.

This arrangement insures that compensation occurs for different thicknesses of the strips 40 of material. This arrangement prevents the shoulder 163 from being prematurely withdrawn from engagement with any of the lobes 161 on the cooperating cam profile 160 of the cam 21 because of the strip 40 of material being thicker than the strip 40 of material for which the adjusting screw 57 had previously been set.

Considering the operation of the apparatus of the present invention, the L-shaped block 29 is adjustably positioned, as more particularly shown and described in the aforesaid Schmidt et al. patent, to insure that each of the cut segments of the strip 40 of material is cut to a selected length. It should be understood that the L-shaped block 29 normally remains in the same position for many connected portions of the strip 40 of material.

To begin the operation, the strip 40 of material must be fed through the opening 61 in the lead-in guide 62, over the guide roll 63, and then through the opening in the feed-in guide 64. The arm 50 of the lever 43 is moved downwardly against the force of the springs 47 and 48 by pivoting of the lever 43 counterclockwise (as viewed in FIG. 3) about the axis of the pin 46 to allow the roller 41 to move away from the knurled roller 17 so that the strip 40 of material may be passed therebetween after passing through the opening in the feed-in guide 64.

If the operator wants to insure that the first cut segment is of at least the desired length, it is necessary to feed the strip 40 of the material down through the opening in the guide 116 until the end of the strip 40 of material has at least passed the knife or cutting blade 109. Then, the operator depresses the button 118' of the valve housing 119 by pushing inwardly on the tray 117 to cause the supply of a pulse of pressurized air through the hoses 136 and 148.

With the lever 138 of the valve housing 134 in the automatic mode, the pulse of pressurized air flows from the hose 145, which is connected to the source of pressure through the fitting 75, through the valve housing 146, the hose 137, the valve housing 134, the hose 99, the housings 95 and 96, and the hose 100 to the fourth passage in the fluid distribution block 76. This shifts the valve spool in the valve housing 79 so that pressurized air flows from the source of pressure through the fitting 75 and the connection 80 to the second passage in the fluid distribution block 76 and the second passage in the fluid distribution block 83.

Because of the position of the valve spool in the valve housing 90, the second passage in the fluid distribution block 83 communicates only with the hose 27 and cannot communicates with the hose 92. As a result, pressurized air is supplied to the top of the air cylinder 25 to move the rack 23 downwardly to rotate the knurled roller 17.

The downward movement of the rack 23 ceases when the piston of the piston rod 24 engages the spacer, which is supported by the air cylinder 24 within the spring in the air cylinder 25. Just prior to the rack 23 ceasing downward movement, the resiliently biased button 70 of the valve housing 67 is moved inwardly by the finger 65 being engaged by the bottom of the rack 23. When this occurs, pressurized air flows from the hose 72 to the hose 73 to shift the position of the valve spool in the valve housing 90. This causes the hose 92 to communicate with the second passage in the fluid distribution block 83 to supply pressurized air to the air cylinder 94 to advance the cutting blade 108 to cut the material, which has been fed by the knurled roller 17, after feeding of the strip 40 of material has stopped.

This shifting of the valve spool in the valve housing 90 connects the hose 27 to atmosphere through the exhaust port in the valve housing 90. This results in the air within the cylinder 25 venting through the port 98 (see FIG. 7) in the quick exhaust valve housing 95. The removal of air from the air cylinder 25 enables the spring in the air cylinder 25 to return the rack 23 to its uppermost position, which is determined by engagement of the stop 28 on the rack 23 with the L-shaped block 29.

When the cutting blade 108 is advanced to cut a portion of the strip 40 of material by cooperating with the stationary cutting blade 109 as shown and described in the aforesaid Schimdt et al patent, the finger 120 on the connecting means 107 engages the arm 121 to move the resiliently biased button 125 of the valve housing 124 into the valve housing 124. This changes the position of the valve in the valve housing 124 to allow pressurized air to be supplied through the hoses 72 and 126, the valve housing 124, and the hose 127 to the third passage in the fluid distribution block 76. This shifts the position of the valve spool in the valve housing 79 to remove pressurized air from the second passages in the fluid distribution blocks 76 and 83 and to supply pressurized air to the first passages in the fluid distr:bution blocks 76 and 83.

The supply of pressurized air through the first passages in the fluid distribution blocks 76 and 83 to the valve housing 90 causes the valve spool in the valve housing 90 to be shifted to the position in which the hose 92 communicates with the exhaust port in the valve housing 90 and the hose 27 again communicates with the second passage in the fluid distribution block 83. The supply of pressurized air through the first passages in the fluid distributio distribution 76 and 83 also causes pressurized air to be supplied through the hose 130 to return the cutting blade 108 to its inactive position. Since the hose 92 is connected to the atmosphere, the cutting blade 108 may be easily returned to its inactive position when pressurized air is supplied through the hose 130.

When the finger 120 is retracted with the piston rod 106 of the air cylinder 94, the button 125 is again resiliently urged outwardly from the valve housing 124. This moves the valve in the valve housing 124 to block communication between the hoses 126 and 127.

When the valve in the valve housing 124 blocks flow of pressurized air from the hose 126 to the hose 127, the hose 127 is vented to the atmosphere through the valve in the valve housing 124. However, the valve spool in the valve housing 79 does not change its position until another pulse of pressurized air is supplied to the inlet port of the valve housing 79 through the hose 100 and the fourth passage in the fluid distribution block 83.

As soon as the rack 23 reaches its uppermost position whereby there is no air flowing through the sensing valve housing 96, the valve in the sensing valve housing 96 allows communication between the hoses 99 and 100 whereby pressurized air is supplied to the inlet port of the valve housing 79 through the fourth passage in the fluid distribution block 83 to shift the valve spool in the valve housing 79 to the position in which pressurized air is supplied to the second passages in the fluid distribution blocks 76 and 83 and removed from the first passages in the fluid distribution blocks 76 and 83. Then, another cutting cycle occurs in the manner previously described.

These cutting cycles automatically continue until the cutting cycle in which the thickened portion of the strip 40 initially enters between the rollers 17 and 41. When this occurs, the roller 41 is pushed away from the roller 17 whereby the arm 50 of the lever 43 pivots counterclockwise (as viewed in FIG. 3).

This results in the lever 54 pivoting counterclockwise about the axis of the pin 55 to cause the arm 56 of the lever 54 to engage the cooperating cam profile 160 of the cam 21 and the shoulder 163 on the finger 156 to be withdrawn from engagement with one of the lobes 161 on the cooperating cam profile 160 of the cam 21. This allows the cam 21 to rotate a slight amount clockwise (as viewed in FIG. 3) until the shoulder 164 on the arm 56 engages the same one of the lobes 161 on the cooperating cam profile 160 of the cam 21 to stop rotation of the cam 21 with the shaft 16.

When the thickened portion of the strip 40 of material is no longer between the rollers 17 and 41 due to an advance therefrom by downward movement of the rack 23, the springs 47 and 48 urge the lever 43 clockwise so that the lever 54 pivots clockwise about the axis of the pin 55. The clockwise pivoting of the lever 54 removes the shoulder 164 on the finger 56 from engagement with one of the lobes 161 on the cooperating cam profile 160 of the cam 21 so that the cam 21 is no longer held against clockwise rotation.

Then, the cam 21 rotates clockwise with the shaft 16 for a distance corresponding to that required to advance the thickened portion of the strip 40 of material from the position in which it ceases to be disposed between the rollers 17 and 41 until it is positioned so that all the thickened portion can be cut by the cutting blade 108. When this amount of clockwise rotation of the cam 21 has occured, the shoulder 173 on the upper end of the link 172 is engaged by another of the lobes 161 on the cooperating cam profile 160 of the cam 21 to be moved downwardly to move the finger 176 downwardly.

When one of the lobes 161 on the cooperating cam profile 160 of the cam 21 engages the shoulder 173 on the upper end of the link 172 to cause downward movement of the link 172, the valve in the valve housing 67 and the valve spool in the valve housing 146 have their positions shifted. This results in communication between the hoses 145 and 137 being blocked by the valve spool in the valve housing 146 and communication being permitted between the hoses 72 and 73 by the valve in the valve housing 67. This stops downward movement of the rack 23 to stop feeding of the strip 40 of material and causes advancement of the cutting blade 108 to cut the strip 40 of material.

When the cutting blade 108 completes its advancement, the finger 120 not only causes the valve in the valve housing 124 to have its position shifted whereby the valve spool in the valve housing 79 has its position changed (This shifting of the valve spool in the valve housing 79 causes the valve spool in the valve housing 90 to have its position changed.) but also removes the link 172 from engagement with the lobe 161 on the cooperating cam profile 160 of the cam 21. Accordingly, pressurized air is supplied through the hose 130 to the air cylinder 94 to retract the cutting blade 108, and the upper end of the air cylinder 25 is vented through the quick exhaust valve housing 95 whereby the spring in the air cylinder 25 returns the rack 23 to its uppermost position as determined by the engagement of the stop 28 with the L-shaped block 29.

To again cut a segment from the strip 40 of the material, it is necessary for the button 118' of the valve housing 119 to be manually depressed by the operator through removing the cut segments from the tray 117. When this occurs, a pulse of pressurized air is supplied through the hose 148 to the valve housing 146 to shift the position of the valve spool therein to allow the hoses 145 and 137 to communicate. Continuous cutting occurs until another thickened portion of the strip 40 of material passes between the rollers 17 and 41.

When the next cutting of the selected length of the strip 40 of material occurs through depressing the button 118' of the valve housing 119, the cam 21 rotates with the shaft 16. This rotation of the cam 21 is slightly less than 60° after one of the lobes 161 is not engaging the shoulder 173 on the upper end of the link 172 before the rotation of the cam 21 is stopped by the shoulder 163 on the finger 156 engaging another of the lobes 161 on the cam profile 160 of the cam 21.

While the cam 21 has been shown and described as having the single cam profile with a plurality of lobes, it should be understood that the cam 21 could have two profiles if desired. With the two profiles, the cam 21 would have one of the lobes on each of the cam profiles with one of the lobes adapted to engage the shoulders 164 and 163 on the arm 56 and the finger 156 respectively and the other at the lobes adapted to engage the shoulder 173 on the upper end of the link 172. In this arrangement, the cam 21 rotates for more than one cutting cycle after cutting the thickened portion of the strip 40 of material. The cam 21 continues to rotate until the shoulder 163 of the finger 156 engages the cooperating lobe on the cam profile of the cam 21 to stop clockwise rotation of the cam 21 with the shaft 16. Thus, completion of the revolution of the cam 21 does not occur until after more than one cutting cycle.

If the apparatus is to operate in the manual mode, the lever 138 of the valve housing 134 is positioned so that the valve in the valve housing 134 blocks any communication of the hoses 137 and 99 while providing communication of the hose 136 with the hose 99. In this arrangement, it is necessary for the button 118' of the valve housing 119 to be manually depressed after the rack 23 has returned to its upper most position for another cutting cycle to occur. Thus, in the manual mode, there is no automatic supply of a pulse of pressurized air as soon as the rack 23 reaches its uppermost position. However, it should be understood that the valve spool in the valve housing 146 is shifted at the initial depression of the button 118' of the valve housing 119 after a thickened portion of the strip 40 of material has passed through the rollers 17 and 41 and continues to be held in this position until the next time that a thickened portion of the strip 40 of material passes between the rollers 17 and 41 to cause the button 150 of the valve housing 146 to be depressed.

Therefore, in the manual mode of operation, each advance of the strip 40 of material to cut a selected length of the material is under the control of the operator. Once the operator depresses the button 118' of the valve housing 119, a complete cycle occurs to cut the selected length. At the completion of the cutting cycle, the apparatus is inactivated until the operator again depresses the button 118' of the valve housing 119.

The apparatus of the present invention also may be employed to automatically cut a strip of material in which the strip of material has the adjacent ends of portions of the strip spaced from each other with threads connecting these spaced adjacent ends to each other to form the continuous strip of material. The apparatus of the present invention requires certain minor changes to enable the automatic cutting of the strip of material after the thin portion, which is produced by the threads sewing the adjacent spaced ends of two portions from two pieces or lays of material to each other, has been advanced by the knurled roller 17 just beyond the position at which the cutting blade 108 cuts the strip 40 of material.

Referring to FIG. 5 of the drawings, one of the lobes 161 of the cam 21 is shown engaging a shoulder 191 on the arm 56 of the lever 54. Furthermore, the finger 156 has a shoulder 192 thereon that is spaced above the shoulder 191. The arm 56 no longer has the shoulder 164, and the finger 156 no longer has the shoulder 163.

Thus, when the thin portion of the strip 40 of material passes between the rollers 17 and 41, the lever 43 pivots clockwise to cause the lever 54 to pivot clockwise about the axis of the pin 55. This results in the shoulder 191 of the arm 56 being withdrawn from engagement with the lobe 161 and the finger 156 being urged by the spring 159 into the position in which the shoulder 192 of the finger 156 can engage the same one of the lobes 161 on the cam profile 160 of the cam 21 when the cam 21 rotates slightly clockwise due to the shoulder 191 being withdrawn from engagement with the lobe 161. Thus, the initial clockwise rotation of the of the cam 21 is due to the thin portion of the strip of material entering between the rollers 17 and 41 to enable the roller 41 to move closer to the roller 17.

Due to the absence of any material except for the threads between the adjacent connected ends of two portions formed from two lays or pieces of material, the rollers 17 and 41 must engage in this embodiment. Thus, it is necessary to coat the knurled roller 17 and/or the roller 41 with a suitable protective material such as rubber, for example.

When the threaded portion of the strip of material ceases to pass between the rollers 17 and 41, the normal portion of the strip 40 of material causes the lever 43 to pivot counterclockwise (as viewed in FIG. 3) whereby the lever 54 pivots counterclockwise about the axis of the pin 55. When this occurs, the shoulder 192 of the finger 156 is withdrawn from engagement with the lobe 161 on the cam profile 160 of the cam 21 whereby the cam 21 now rotates with the shaft 16 until another of the lobes 161 is engaged by the shoulder 173 on the upper end of the link 172 in the manner previously described. The remainder of the operation is the same as that described for the apparatus of FIGS. 1 to 4. Thus, the only difference is that a thin portion, which is less than a predetermined thickness of the strip 40 of material, is sensed as to when it initially passes between the rollers 17 and 41 and when the thin portion of the strip 40 of material ceases to pass between the rollers 17 and 41.

While the air cylinder 25 has been shown and described as utilizing the spring in the air cylinder 25 to move the rack 23 upwardly, it should be understood that an air cylinder could be utilized in which air is employed to move the rack 23 upwardly rather than a spring if desired. This type of air cylinder has been shown and described in the aforesaid Schmidt et al patent. It would be necessary to connect the hose, which supplies the pressurized air to the air cylinder to move the rack 23 upwardly, to receive pressure at the same time as the hose 130.

While the present invention has shown and described the knurled roller 17 and the roller 41 as being spaced from each other except when the strip 40 of material having adjacent strips joined by threads is employed, it should be understood that the rollers 17 and 41 could engage each other at all times if desired. Of course, this would require the rollers 17 and 41 to be coated in the same manner as described when the rollers 17 and 41 are utilized with the strip of material having adjacent strips joined by threads.

Referring to FIG. 8, there is shown a modification of the present invention in which the cut segments, which are to be discarded because of being thicker than a predetermined thickness or thinner than a predetermined thickness, are automatically discarded. This arrangement contemplates a diverter 200, which is pivotally mounted by a pin 201 between the support blocks (one shown at 110) supported by the support or frame 12 and is preferably U-shaped in cross section. The diverter 200 is pivotally connected to the end of a piston rod 202 of an air cylinder 203, which is supported by the air cylinder 94 through the air cylinder 203 being pivotally connected to a bracket 203' mounted on the air cylinder 94. The air cylinder 203 has a spring (not shown) therein continuously urging the piston rod 202 to the left so that the diverter 200 is aligned with a tray 204, which is mounted on the support or frame 12. One suitable example of the air cylinder 203 is sold by Bimba Manufacturing Company, Monee, Ill. as model 041-RP.

The diverter 200 is moved to the position of FIG. 8 only when air pressure is supplied to the cylinder 203 through a hose (not shown). In the position of FIG. 8, the diverter 200 is aligned with a discard chute 205, which is secured to the tray 204 and preferably integral therewith, to which the non-usable cut segments are directed by the diverter 200.

The hose to the cylinder 203 is connected to the valve housing 146 so that pressurized air is supplied from the source of pressure through the hose 145 and the valve housing 146 only when the button 150 of the valve housing 146 is moved inwardly into the valve housing 146 by the link 172 engaging the finger 176 to shift the postion of the valve spool in the valve housing 146. This results in air pressure being supplied to the air cylinder 203 to move the diverter 200 to the position of FIG. 8 only when the portion, which exceeds a predetermined thickness or is less than a predetermined thickness of the strip 40 of material, has been advanced to the cutting postion. Thus, this arrangement insures that the diverter 200 is in the position of FIG. 8 prior to cutting of the portion of the strip 40 of material that exceeds a predetermined thickness or is less than a predetermined thickness.

If desired, a control valve can be disposed in parallel with the valve housing 119 to enable continuous supply of pressurized air to the hose 148. As a result, the valve spool in the valve housing 146 is automatically returned to the position in which the hoses 145 and 137 communicate as soon as upward movement of the link 172 begins.

Accordingly, the modification of FIG. 8 enables continuous cutting of the strip 40 of material without any stopping of the cutting operation until desired. Since all of the non-usable segments are diverted by the diverter 200 to the chute 205, which is preferably U-shaped in cross section, the usable segments are collected in the tray 204. Of course, with continuous cutting, it is necessary for the operator to select the particular segments for use with the particular lay or piece of material.

In stead of the apparatus requiring the depression of the button 118' of the valve housing 119 every time after the thickened or thin portion of the strip 40 of material has been cut, it should be understood that this could occur every second time. With this arrangement, it would not be necessary for the operator to depress the button 118' of the valve housing 119 except after each time that all of the cut segments forming the belt loops for a particular pair of pants have been cut.

An advantage of this invention is that it is only necessary for the operator to activate cutting at the end of each strip having a different thickness than the remainder of the strip. A further advantage of this invention is that the apparatus may be automatically operated to cut all the segments of the same thickneess or to manually cut each segment.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

I claim:

1. In an apparatus for cutting segments from a strip of material including feed means to feed the material, said feed means including means movable from a first position to feed the material, first inactivating means to inactivate said feed means to stop feeding of the material in response to a selected length of the material being fed by said feed means past a cutting position; cutting means to cut the feed material at the cutting position; first responsive means responsive to said feed means to activate said cutting means to cut the fed material substantially simultaneously with stopping of said feed means; second responsive means responsive to said cutting means completing cutting of the fed material to cause return of said cutting means to its inactive position; sensing means to sense when the thickness of the material being fed by said feed means exceeds a predetermined thickness and when the thickness of the material being fed by said feed means ceases to exceed the predetermined thickness after having exceeded the predetermined thickness or when the thicknss of the material being fed by said feed means is less than a predetermined thickness and when the thickness of the material being fed by said feed means ceases to be less than the predetermined thickness after having been less than the predetermined thickness; second inactivating means to cause inactivation of said feed means after said sensing means has sensed that the thickness of the material has ceased to exceed the predetermined thickness after having exceeded the predetermined thickness or has sensed that the thickness of the material has ceased to be less than the predetermined thickness after having been less than the predetermined thickness irrespective of whether said feed means has fed the selected length of material, said second inactivating means causing activation of said cutting means substantially simultaneously with inactivation of said feed means; the improvement comprising:

automatic means to cause activation of said feed means;

initiating means to activate said automatic means to cause initial activation of said feed means by said automatic means wherever said automatic means is ineffective, said automatic means causing activation of said feed means each time that said movable means of said feed means returns to its first position after said feed means is initially activated; and third inactivating means to inactivate said automatic means in response to said second inactivating means being effective.

2. The improvement according to claim 1 including:

activating means to cause inactivation of said feed means, said activating means including said initiating means; and selecting means to select whether said automatic means activates said feed means each time that said movable means of said feed means returns to its first position until said third inactivating means is effective to inactivate said automatic means or whether said activating means must be activated to cause each activation of said feed means upon said movable means of said feed means returning to its first position.

3. The improvement according to claim 2 in which said third inactivating means inactivates said automatic means in response to each time that said second inactivating means is effective.

4. The improvement according to claim 2 including means responsive to said third inactivating means being effective to divert the segment cut by said cutting means when said cutting means is activated by said second inactivating means from the area to which the other cut segments are diverted.

5. The improvement according to claim 2 including means to sense when said movable means of said feed means is at its first position to prevent activation of said feed means by said automatic means until said movable means of said feed means is at its first position.

6. The improvement according to claim 2 including:

means to apply fluid pressure to said movable means of said feed means to move said movable means from its first position to feed the material; and said automatic means includes:

means to provide the start of communication from a source of fluid pressure to said fluid pressure applying means only when said movable means of said feed means is in its first position; and means to render said automatic means effective in response to a signal from activation of said initiating means whenever said automatic means has been rendered ineffective.

7. The improvement according to claim 1 in which said third inactivating means inactivates said automatic means in response to each time that said second inactivating means is effective.

8. The improvement according to claim 1 including means responsive to said third inactivating means being effective to divert the segment cut by said cutting means when said cutting means is activated by said second inactivating means from the area to which the other cut segments are diverted.

9. The improvement according to claim 1 including means to sense when said movable means of said feed means is at its first position to prevent activation of said feed means by said automatic means until said movable means of said feed means is at its first position.

10. In an apparatus for cutting segments from a strip of material including feed means to feed the material, said feed means including means movable from a first position to feed the material; first inactivating means to inactivate said feed means to stop feeding of the material in response to a selected length of the material being fed by said feed means past a cutting position; cutting means to cut the feed material at the cutting position; first responsive means responsive to said feed means to activate said cutting means to cut the fed material substantially simultaneously with stopping of said feed means; second responsive means responsive to said cutting means completing cutting of the fed material to cause return of said cutting means to its inactive position; sensing means to sense when the thickness of the material being fed by said feed means exceeds a predetermined thickness and when the thickness of the material being fed by said feed means ceases to exceed the predetermined thickness after having exceeded the predetermined thickness or when the thickness of the material being fed by said feed means is less than a predetermined thickness and when the thickness of the material being fed by said feed means ceases to be less than the predetermined thickness after having been less than the predetermined thickness; second inactivating means to cause inactivation of said feed means after said sensing means has sensed that the thickness of the material has ceased to exceed the predetermined thickness after having exceeded the predetermined thickness or has sensed that the thickness of the material has ceased to be less than the predetermined thickness after having been less than the predetermined thickness irresective of whether said feed means has fed the selected length of material, said second inactivating means causing activation of said cutting means substantially simultaneously with inactivation of said feed means; the improvement comprising:

first control means connected to a source of fluid pressure;

second control means connected to said first control means to receive fluid pressure from the source of fluid pressure;

said first control means having first and second positions;

said second control means having first and second control positions;

means to dispose said first control means in its first control position only when said movable means of said feed means is in its first position;

means to supply fluid pressure to act on said movable means of said feed means only when said first control means is in its first control position and said second control means is in its second control position;

said first responsive means including means to dispose said second control means in its first control position to activate said cutting means to cut the fed material at the cutting position and to remove fluid pressure from acting on said movable means of said feed means to move said movable means from its first position; and said second responsive means including means to dispose said first control means in its second control position to allow fluid pressure to be supplied from said first control means through said second control means when said second control means is in its second control position to remove fluid pressure from acting on said cutting means to move said cutting means to its cutting position and to apply fluid pressure to said cutting means to return said cutting means to its inactive position.

11. The improvement according to claim 10 in which said disposing means for said first control means includes:

means connected to the source of fluid pressure to supply fluid pressure to said first control means to disose said first control means in its first control position; and said connected means including means to prevent supply of fluid pressure from the source of fluid pressure to dispose said first control means in its first control position until said movable means of said feed means is in its first position.

12. The improvement according to claim 11 in which said connected means includes manually activated means to connect the source of fluid pressure for supply to said first control means.

13. The improvement according to claim 11 in which said connected means includes:

means continuously connected to the source of fluid pressure;

means to activate said continuously connected means to enable supply of fluid pressure to said first control means whenever said movable means of said feed means is in its first position; and means to inactivate said continuously connected means when said second inactivating means has inactivated said feed means a predetermined number of times.

14. The improvement according to claim 11 in which said connected means includes:

manually activated means to connect the source of fluid pressure for supply to said first control means;

means continuously connected to the source of fluid pressure;

means to activate said continuously connected means to enable supply of fluid pressure to said first control means whenever said movable means of said feed means is in its first position;

means to inactivate said continuously connected means when said second inactivating means has inactivated said feed means a predetermined number of times; and selecting means to enable only one of said manually activated means and said continuously connected means to connect the source of fluid pressure to said first control means.

* * * * *

UNITED STATES PATENT OFFICE

CERTIFICATE OF CORRECTION

Patent No. 4,033,215 Dated July 5, 1977

Inventor(s) Volker Schmidt

It is certified that error appears in the above-identified patent and that said Letters Patent are hereby corrected as shown below:

Column 2, line 42, "A" should be the beginning of a new paragraph.

Column 2, line 50, "The" should be the beginning of a new paragraph.

Column 3, line 6, "Referring" should be the beginning of a new paragraph.

Column 3, line 61, "FIG." should be -- FIGS. --.

Column 5, line 4, "circlar" should be -- circular --.

Column 5, line 51, "and" should be -- to --.

Column 7, line 5, after "2" insert a parenthesis -- ) --.

Column 7, line 53,, "fludi" should read -- fluid --.

Column 7, line 60, after "94" insert a comma -- , --.

Column 8, line 1, "housing" should be -- housings --.

Column 8, line 10, after "position" insert -- in --.

Column 9, line 53, after "pulse" insert -- of --.

Column 13, line 26, after "56" insert a comma -- , --.

UNITED STATES PATENT OFFICE

CERTIFICATE OF CORRECTION

Patent No. 4,033,215 Dated July 5, 1977

Inventor(s) Volker Schmidt

It is certified that error appears in the above-identified patent and that said Letters Patent are hereby corrected as shown below:

Column 13, line 34, "hinged" should be -- hingedly --.

Column 16, line 5, "of" should be -- or --.

Column 16, line 65, "communicates" should be -- communicate --.

Column 17, line 3, "24" should be -- 25 --.

Column 17, line 50, cancel "distributio".

Column 17, line 50, after "distribution" insert -- blocks --.

Column 19, line 43, "at" should be -- of --.

Column 19, line 60, "upper most" should be -- uppermost --.

Column 20, line 45, cancel "of the"

Column 20, line 52, "and-" should be -- and --.

Column 22, line 19, "In stead" should be -- Instead --.

Column 22, line 50, "feed" should be -- fed --.

Column 23, line 26, "inactivation" should be -- activation --.

Column 24, line 21, "feed" should be -- fed --.

Column 24, line 46, "irresective" should be -- irrespective --.

UNITED STATES PATENT OFFICE

CERTIFICATE OF CORRECTION

Patent No. 4,033,215 Dated July 5, 1977

Inventor(s) Volker Schmidt

It is certified that error appears in the above-identified patent and that said Letters Patent are hereby corrected as shown below:

Column 24, line 57, after "second" insert -- control --.

Column 25, line 24, "disose" should be -- dispose --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*